US005253760A

United States Patent [19]

Miller

[11] Patent Number: 5,253,760

[45] Date of Patent: Oct. 19, 1993

[54] PROTECTIVE APPARATUS FOR A PRESSURIZED BREATHING DEVICE

[76] Inventor: Don M. Miller, 4949 Stumbung Ln. Apt. 104, Baton Rouge, La. 70816

[21] Appl. No.: 884,457

[22] Filed: May 13, 1992

Related U.S. Application Data

[63] Continuation-in-part of Ser. No. 756,992, Sep. 9, 1991.

[51] Int. Cl.[5] ..... B75D 85/08

[52] U.S. Cl. ..... 206/525; 220/724; 220/725; 224/205

[58] Field of Search ..... 206/525, 6; 220/724, 220/725, 726, 727, 728, 400; 224/202, 205, 224, 901; 137/377, 382

[56] References Cited

U.S. PATENT DOCUMENTS

| | | | |
|---|---|---|---|
| 1,552,979 | 9/1925 | Billings | 220/724 |
| 2,657,817 | 11/1953 | Alvear | 220/352 |
| 2,996,213 | 8/1961 | Mitchell et al. | 220/724 |
| 3,104,681 | 9/1963 | Gray, Jr. | 220/352 |
| 3,476,288 | 11/1969 | Sherrill | 220/725 |
| 3,696,964 | 10/1972 | Deakin | 220/727 |
| 3,756,450 | 9/1973 | Crose, Jr. | 220/724 |
| 3,977,451 | 8/1976 | Duba | 150/159 |
| 4,022,343 | 5/1977 | Richardson | 220/724 |
| 4,103,806 | 8/1978 | White | 220/724 |
| 4,109,692 | 8/1978 | Brown | 220/724 |
| 4,193,507 | 3/1980 | Wise et al. | 150/154 X |
| 4,308,219 | 12/1981 | Kneipkamp | 137/382 X |
| 4,449,654 | 5/1984 | Cappis | 224/224 |
| 4,478,345 | 10/1984 | Edinger | 220/724 |
| 4,600,033 | 7/1986 | Baron | 220/724 |
| 4,678,003 | 7/1987 | Griffin | 220/728 |
| 4,741,457 | 5/1988 | Joseph et al. | 220/724 |
| 4,762,144 | 8/1988 | Ford | 137/377 X |
| 4,827,969 | 5/1989 | Lyasko | 220/724 |
| 4,838,466 | 6/1989 | Holmstrom | 224/901 |
| 4,905,855 | 3/1990 | Troiano et al. | 220/724 |
| 4,967,923 | 11/1990 | Wren | 220/724 |
| 4,979,659 | 12/1990 | Boyd | 224/205 |
| 5,160,065 | 11/1992 | Libes et al. | 220/725 X |

FOREIGN PATENT DOCUMENTS

| | | | |
|---|---|---|---|
| 1596615 | 7/1970 | France | 220/318 |

*Primary Examiner*—Allan N. Shoap
*Assistant Examiner*—Christopher J. McDonald
*Attorney, Agent, or Firm*—C. Dean Domingue; William David Kiesel; Robert C. Tucker

[57] ABSTRACT

A protective apparatus for a pressurized breathing vessel consists of a protective valving member and carrying member. The protective valving member is a rigid member with apertures that allow the gauge and top of the pressurized vessel to be accessible. It also has a slot that extends from the bottom and hook and loop material for attachment to the carrying member. The carrying member is flexible and has mating hook and loop material for attaching the member to the protective valving member. When the carrying member is wrapped tightly around the protective member the slot decreases in size and the protective valving member is held securely to the pressurized breathing vessel.

18 Claims, 7 Drawing Sheets

PROTECTIVE APPARATUS FOR A PRESSURIZED BREATHING DEVICE

This is a continuation-in-part of copending application Ser. No. 07/756,992 filed on Sep. 9, 1991.

BACKGROUND OF THE INVENTION

This invention relates to a protective device for use with a pressurized vessel. More particularly, but not by way of limitation, this invention relates to a protective apparatus for use with a pressurized breathing device such as an oxygen bottle.

In industrial applications, workers many times will be required to perform various duties in and around hazardous breathing areas. Therefore, many industrial companies as well as government agencies, such as the Environmental Protection Agency , have promulgated rules and regulations that require persons working in these areas to have an oxygen supply accessible.

While applicant is aware of no material prior art dealing with this area, several devices have been devised to protect pressurized vessel and/or cylinders. In U.S. Pat. No. 4,645,091 to Madden, et al, a valve cover for a gas storage cylinder is disclosed. The cover comprises a support member affixed to the pressure cylinder and a cap member matingly engageable to the support member by means of a double acting lock.

In U.S. Pat. No. 4,022,343 to J. Richardson, a protective device for compressed gas cylinders is claimed. The patent teaches that it is a primary object of the invention to provide a protector cap for the valve or valve assembly for scuba cylinders. The device comprises a pair of caps each including an end wall and a peripheral skirt. One of those caps is an inverted frustoconical configuration and is adapted to receive in a chamber a valve assembly from the compressed gas cylinder. Also included is aligned grooves on each cap for strap means to hold caps in position.

However, there is a need for a protective device that will effectively isolate the valve assembly and pressurized vessel while at the same time provide means wherein the pressurized vessel can be easily carried by a worker. Therefore, an object of this invention is to provide a protective device for a pressure vessel, such as an oxygen bottle, that is easily transported by a worker. Another object of the invention is to provide a device that allows visual observation of the pressure vessel's gauge, as well as workable access to the pressure line and breathing mask.

SUMMARY OF THE INVENTION

The present invention includes apparatus claims to a protective apparatus for a pressurized breathing device. Generally, the breathing device is a cylindrical vessel approixametly 12" high, with an inner diameter of 4". The device may contain a gas, such as oxygen, under pressure. However, because of the novel features herein claimed, the present invention can also be employed on pressure vessels of all shapes and sizes.

The apparatus comprises a protective valving member and a carrying member. The protective valving member includes a top assembly having an aperture, a cylindrical body being attached to the top assembly and the cylindrical body also contain an apperture, and means for securing the protective valving member to the carrying means.

The carrying means will include a second cylindrical body with a top end and a bottom end, and means for securing the carrying means to the protective valving member. The apparatus can further comprise an auxiliary member that is attached to the carrying means. Belt and shoulder means may be provided for fastening the carrying member around the waist or shoulder of the operator.

The apparatus may be fabricated of a plastic, such as polyproperlene. Alternatively, the apparatus may be constructed of reinforced vinyl nylon. The means for securing the protective valving member is a material known as hook and loop which is sold and marketed under the traded name "velcro"; alternatively, the means for securing the protective valving member are thread means. As will be appreciated by those skilled in the art, the velcro on the protective valving member and the carrying member will cooperate so that the two members, when coupled together, are secured to one another.

The auxiliary member may further include means for securing the auxiliary member to the carrying member and where the carrying member further comprises means for securing the carrying member to the auxiliary member.

Also, the protective valving member may further include a section having a slotted area so that when the securing means is attached with the securing means of the carrying member, a variable size can be obtained. The carrying member may also include a slotted area that will decrease in size, in order to properly secure to the pressurized breathing device as the securing means are secured together, and the slotted area will also allow for the pressure output line to fit therethrough.

A feature of the present invention is the novel protective valving member which encapsulates and isolates the valve means of a pressurized breathing vessel. Another feature includes the projection window which allows for an area for the valve pressure gauge to be included as well as allowing the operator to visually observe the pressure gauge. Yet another feature of the invention includes a slotted groove recess which will for variable tighenting of the protective valve member about the breathing device. Still another feature includes that the slotted area (also known as the slotted groove recess) will decrease in size in order to properly secure the protective valving member to the pressurized breathing device and will allow the pressure output line to fit through the slotted area.

Another feature of the invention is the means of securing the protective valve member to the carrying member. Yet another feature includes the auxiliary member, attachable to the apparatus, to store the breathing line and breathing mask. Still another feature includes the use of belt or shoulder means which allows the worker to easily transport the pressure vessel.

DESCRIPTION OF THE PREFERRED EMBODIMENT

Figure 1:
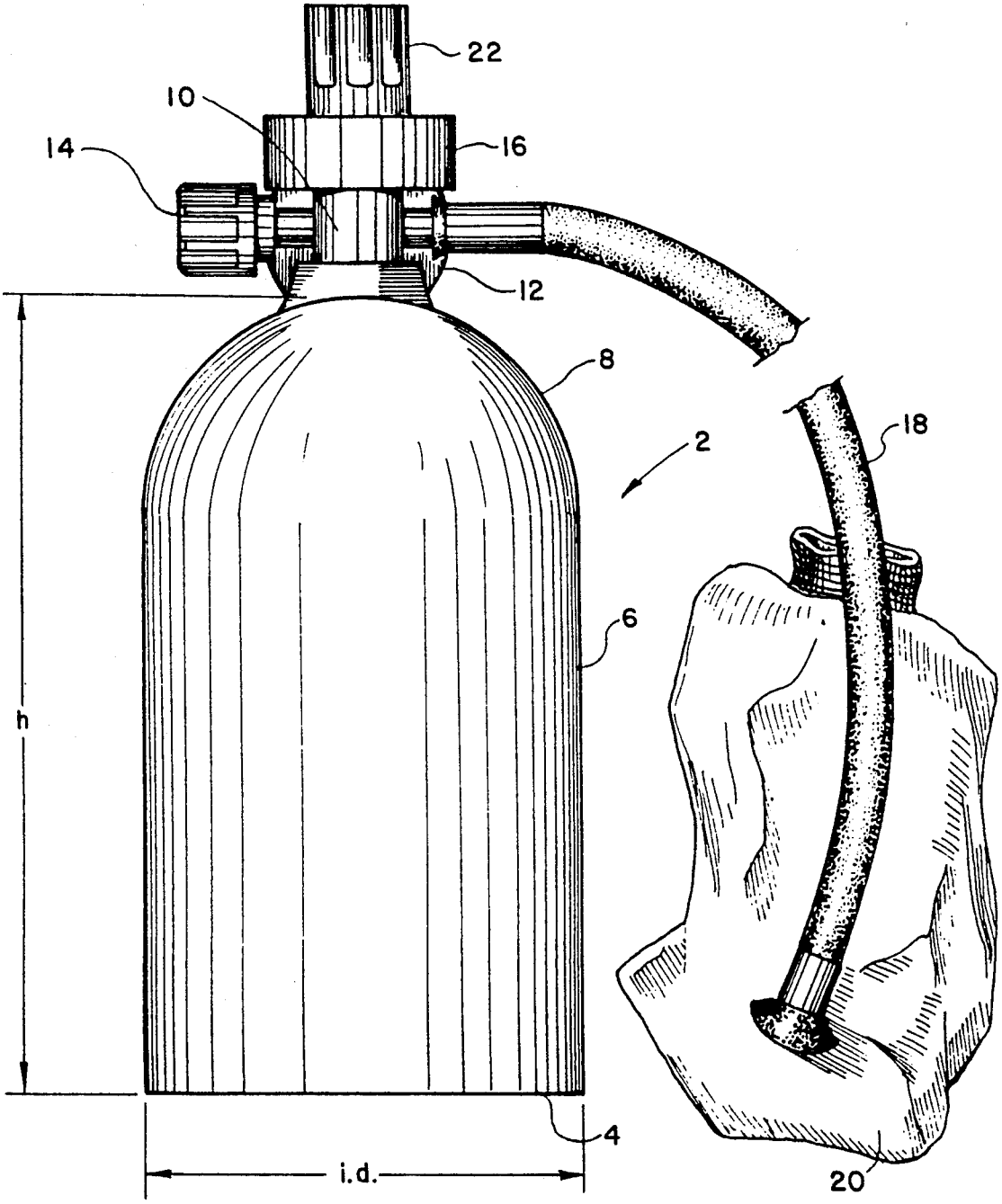
FIG. 1 shows one embodiment of a typical pressurized breathing vessel.

FIG. 1 depicts the typical pressurized breathing device. The pressurized device may be of a height (h) of 12", and an internal diameter (i.d.) of 4". The base 4 of the device is generally circular and the housing 6 is cylindrical. The top portion, seen generally at 8, is conical. While the typical pressurized breathing device has been shown, the invention disclosed herein is applicable to pressurized breathing devices of differing physical configurations and sizes.

The pressurized breathing device also will include a valve stem 10 extending from the conical top portion 8. The valve stem 10 will be to attached to the valve means, seen generally at 12. The valve means will include a valve 14 which is operable between on open and close position. The valve means 12 will also comprise a pressure gauge 16 (see also FIG. 8) so that the pressure within the device may be visually observed, and a pressure line 18. As will be appreciated by those skilled in the art, the pressure line 18 will be connected to a breathing apparatus (breathing bag) 20 which may be fitted around the face of a worker and used to intake the air from the pressurized breathing device 2. The valve means 12 terminates with end lock cap 22.

Figure 2:
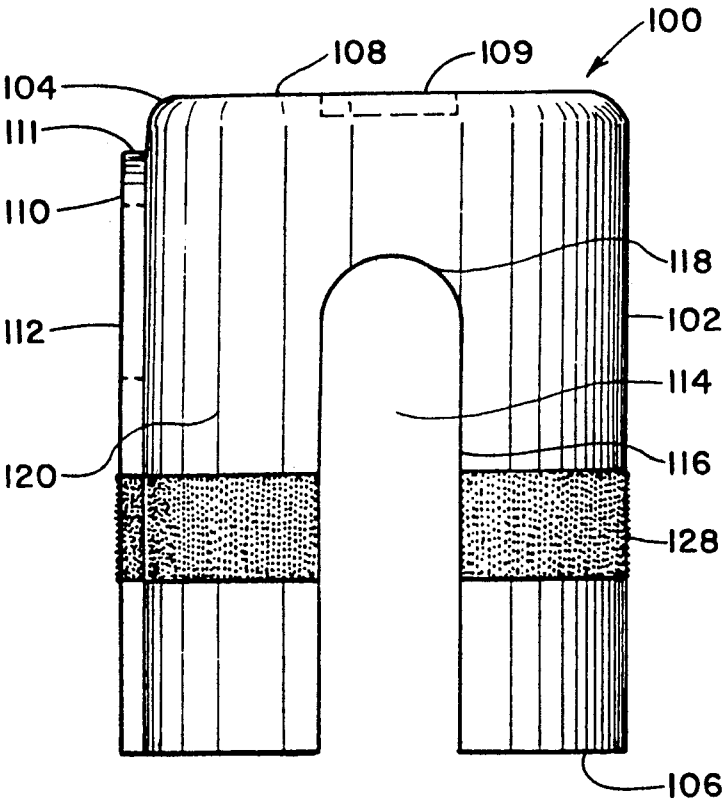
FIG. 2 is a sectional view of the protective valving member.

Referring to FIG. 2, the sectional view of the protective valving member (also known as the first cylindrical member) is seen generally at 100. The protective valving member 100 generally comprises a cylindrical surface 102 with a first end 104 and second end 106.

The first end 104 contains a circular base 108 which forms the top end of the member 100. The circular base 108 contains an apperature 109 through which valve means 12 is fitted therethrough. An O-Ring spacer (not shown) may also be included in order to properly adjust the spacing between the circular base 108 and the valve means 12. The second end 106 has no base, and therefore is opened ended.

The cylindrical surface 102 has defined thereon a side protrusion or window 110. Radially extending surface 111 defines the amount of extension of the side protrusion 110 from the cylindrical surface 102. The side protrusion 110 has formed thereon an apperature 112 through which the pressure gauge 16 will be positioned in order to visually observe the pressure reading.

Figure 3:
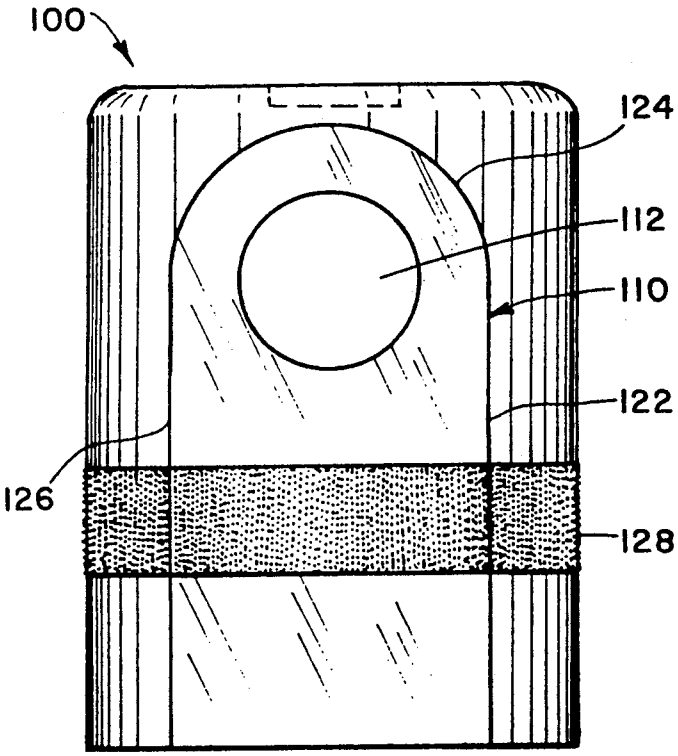
FIG. 3 is a sectional view of the protective valving member showing as a front angle the protrusion member.

FIG. 3 shows the protective valving member 100, with a front end depicting the side protrusion 110. The side protrusion 110 generally comprises a first surface 122, which leads to arch surface 124, which has in turn second surface 126. Also shown is the apperature 112, previously described.

Referring again to FIG. 2, the cylindrical surface 102 will also include a portion having a grooved recess 114. The grooved recess 114 has a first surface 116 extending to arch 118 which in turn leads to second surface 120. This groove recess 114 will allow for variable tightening of the protective breathing device 100 around the top portion of the pressurized breathing device 2, the amount of tightening being dependent on the size of the device 2. The pressure line 18 is also fitted therethrough the groove recess 114, and then the apparatus can be assembled.

Means for securing the protective valving member to the carrying member is shown generally at 28. In the preferred embodiment, the securing means will be velcro; however, thread means or other equivalent means may be employed. The securing means 128 will, thus, attach the protective valving member to the carrying member, and also act to secure and fasten the protective valving member 100 about the pressurized breathing device 2.

Figure 4:
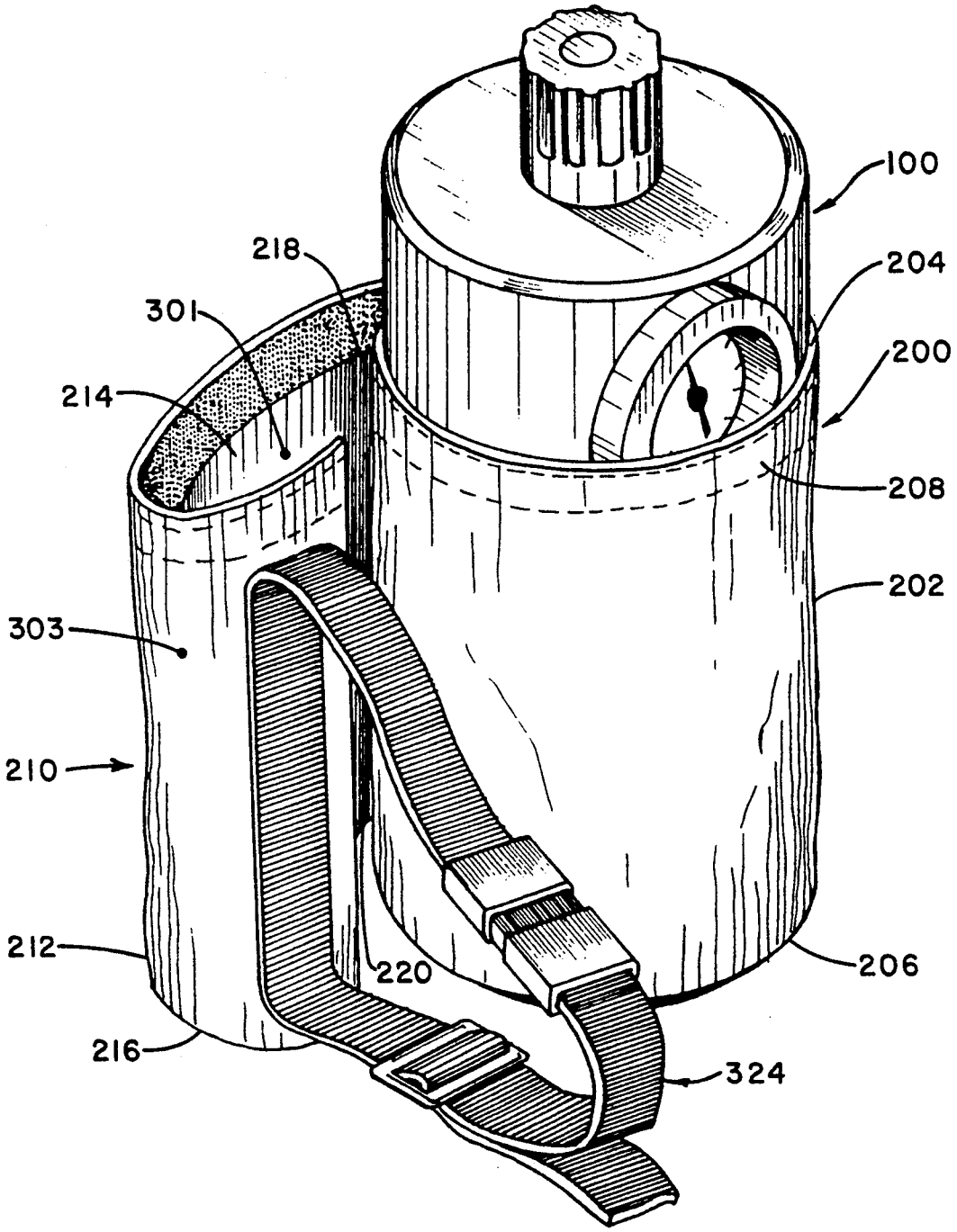
FIG. 4 is a sectional view of the carrying member the auxiliary member, and protective member.

Referring to FIG. 4, the sketch shows a three dimensional view of the carrying member, the auxiliary member, the protective member and pressure vessel. Generally, the carrying member is seen at 200. The carrying member 200 will comprise a cylindrical body 202 with a top end 204 and a bottom end 206. The top end will be opened ended, and bottom end 206 will be a circular base, attached to the cylindrical body 202.

Arranged about the inner diameter circumference of the cylindrical body 202, at the top end 204, is means for securing the carrying means to the protective valving member, which is opposite circumference area 208. Therefore, as the securing means 128 and 209 are secured together, the slotted area 114 (also referred to as the grooved recess) will decrease in size in order to properly secure the protective valving member 100 to the pressurized breathing device 2, and allow the pressure output line 18 to fit through the slotted area 114. In the preferred embodiment of the invention, the securing means 209 will be reciprocal velcro that will mesh with the velcro 128 placed about the perphiery of the protective valving member 100. However, other types of securing means may be employed, such as thread means or zipper means.

Therefore, if thread means were utilized, external thread means would be placed about either the protective valving member 100 or the carrying member 200, and internal thread means would be placed on the other member so that the two members would threadedly mate.

An auxiliary member 210 may also be employed. The auxiliary member is attached to the cylindrical body 202 and would be used to contain the breathing line, breathing mask 18,20 and any other associated parts. In the preferred embodiment, the auxiliary member is of general cylindrical shape, comprising a cylindrical container 212 of which a portion has been eclipsed by the cylindrical surface 202. In this manner, the auxiliary member 210 is fitted about the perphiery of cylindrical surface 202.

The auxiliary member 210 may contain a top portion 214 (not shown) placed in the aperature 215 and a bottom portion 216. Both the top and bottom portion 214, and 216 respectively, are of general circular configuration except for the eclipsed portions seen at 218 and 220. This eclipsed cylindrical shape of the auxiliary member 210 allows for convientent storage of the breathing mask 20, and pressure line 18, while also allowing for efficient use of space since the auxiliary member can be partially fitted about the perphiery of the carrying member 200.

The carrying member 200 may be constructed of any suitable plastic, such as poly properlene. Woven fabric or cloth may also be employed. In the preferred embodiment, the carrying member 200 will fabricated from vinyl nylon. This material is used because of its resistance to water and oil, as well as the materials restance to general wear and tear.

The auxiliary member 210 may also be constructed of any suitable plastic, such as poly properlene. Woven fabric or cloth may also be used. In the preferred embodiment, the auxiliary member, like the carrying member 200, will be constructed from reinforced vinyl nylon.

Figure 5:
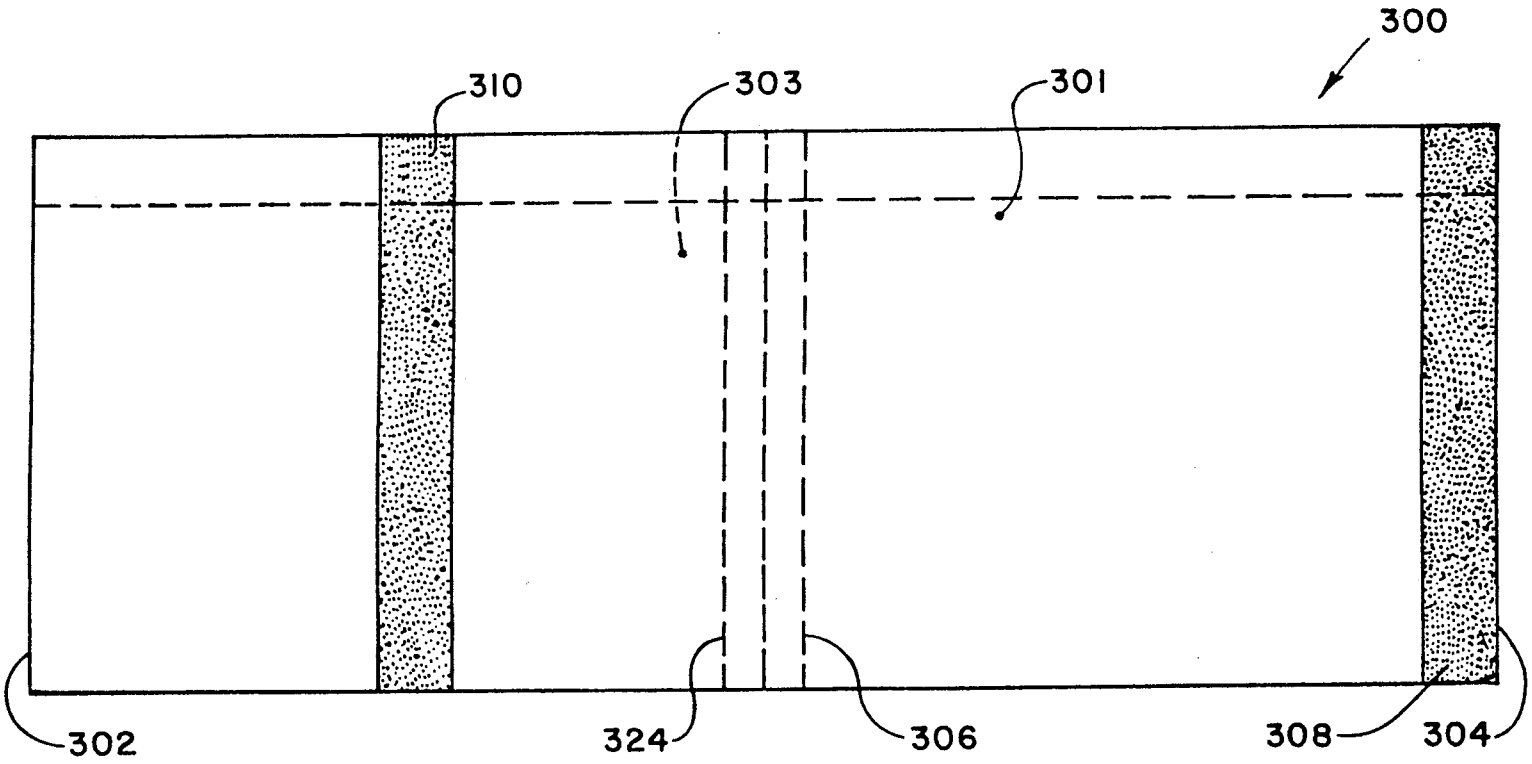
FIG. 5 is a planar view of the unwrapped surface of the carrying member and auxiliary member.

In order to attach the auxiliary member 210 to the cylindrical body 202, any suitable method of attachment may be employed. Referring to FIG. 5, the preferred embodiment of construction of the carrying member and the auxiliary member is shown. The surface, seen generally at 300, contains a first end 302 and a second end 304. The surface 300 also has an inner side 301 and an outer side 303. First end 302 will be joined at joining end 306. The joining will be accomplished in the preferred embodiment by sewing first end 302 with the joining end 306. At this point, the cylindrical body 202, previously shown in FIG. 4, has been formed.

Referring again to FIG. 5, a velcro attachment means 308 has been placed along the second end 304 on the inner side 301 (see also FIG. 4). Also, a recipercial velcro attachment means 310 has been placed on the surface 300, except the velcro attachment means has been placed along the outer side 303 (see also FIG. 4) of the surface 300. Thus, after the first end 302 has been joined to the joining end 306, the velcro attachment means 308 can be coupled with reciprocal velcro attachment means 310, which will form the auxiliary member 210.

The auxiliary member may require the previously described top portion 214 and bottom portion 216, which will be circular portions cut-out (or eclipsed) by the contour of the cylindrical body. The top and bottom portion 214, 216 will have a convex planar surface and a concave planar surface.

Figure 8:
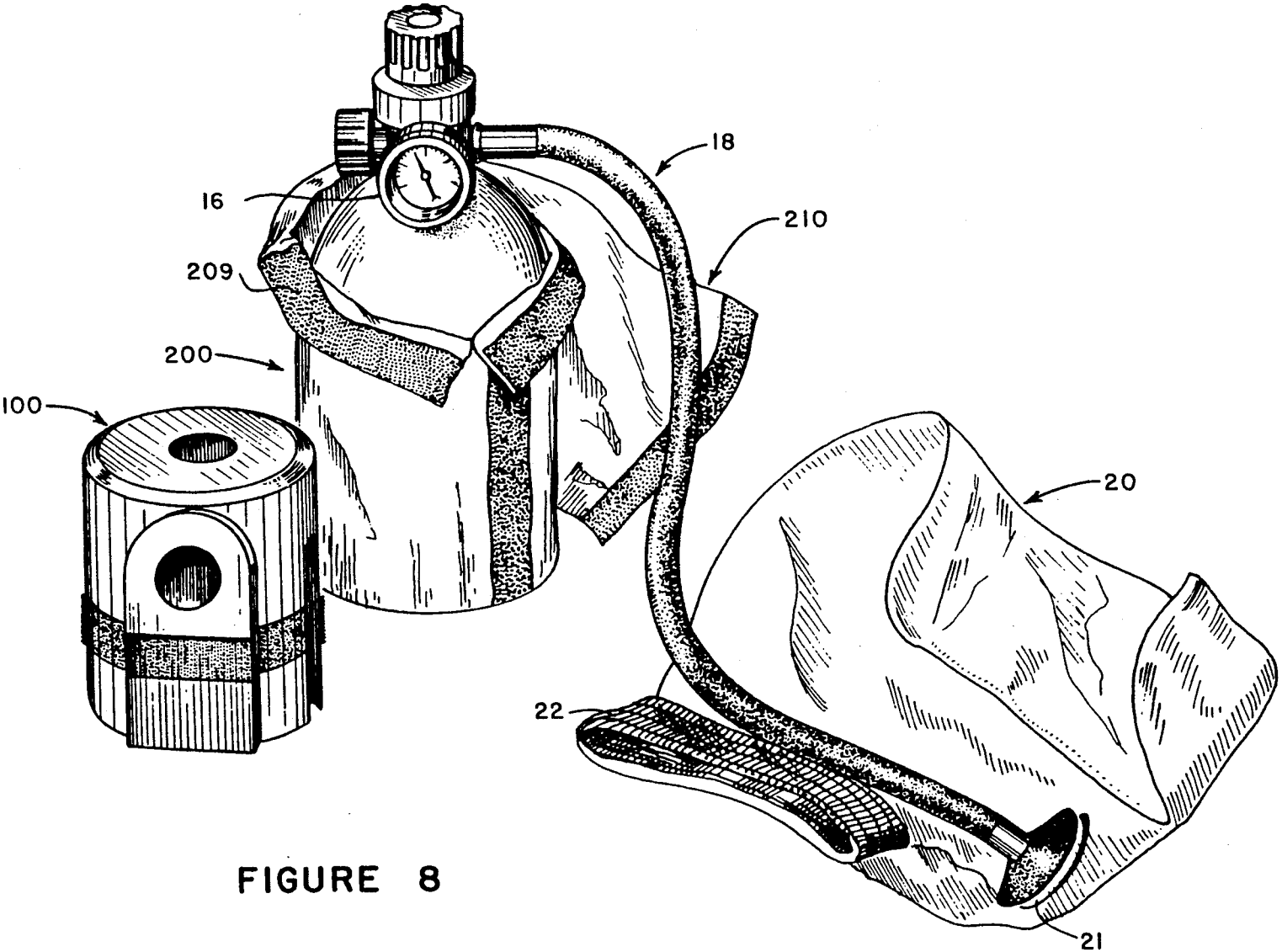
FIG. 8 is a three dimensional view of the protective valving member, pressurized breathing vessel, carrying member, auxiliary member, and assiociated breathing line/breathing bag.

Shoulder or belt means are also provided. Referring to FIG. 4, the belt and/or shoulder means 324 is a harness type of fastening means which can be place about the worker. FIG. 8 depicts a three dimensional view of the invention wherein the protective valving member 100, the carrying member 200, auxially member 210, and the breathing line/breathing mask (18, 20 ) are shown. The breathing line 18 is connected to the breathing mask at 21. The elastic band 22 serves as an opening to allow the operator to install the breathing mask 20 over his head.

Referring again to FIG. 4, in the preferred embodiment, the belt means 324 will be sewed to the outer surface 303. At this position, the belt means 324 can be fitted around the waist of the worker with ease and comfort. Also, placement of the belt means (and shoulder means) at the position shown, allows the worker easy access to the auxiliary member 210. The belt or shoulder means 324 may be modified and adjusted according to the particular worker.

Figure 6:
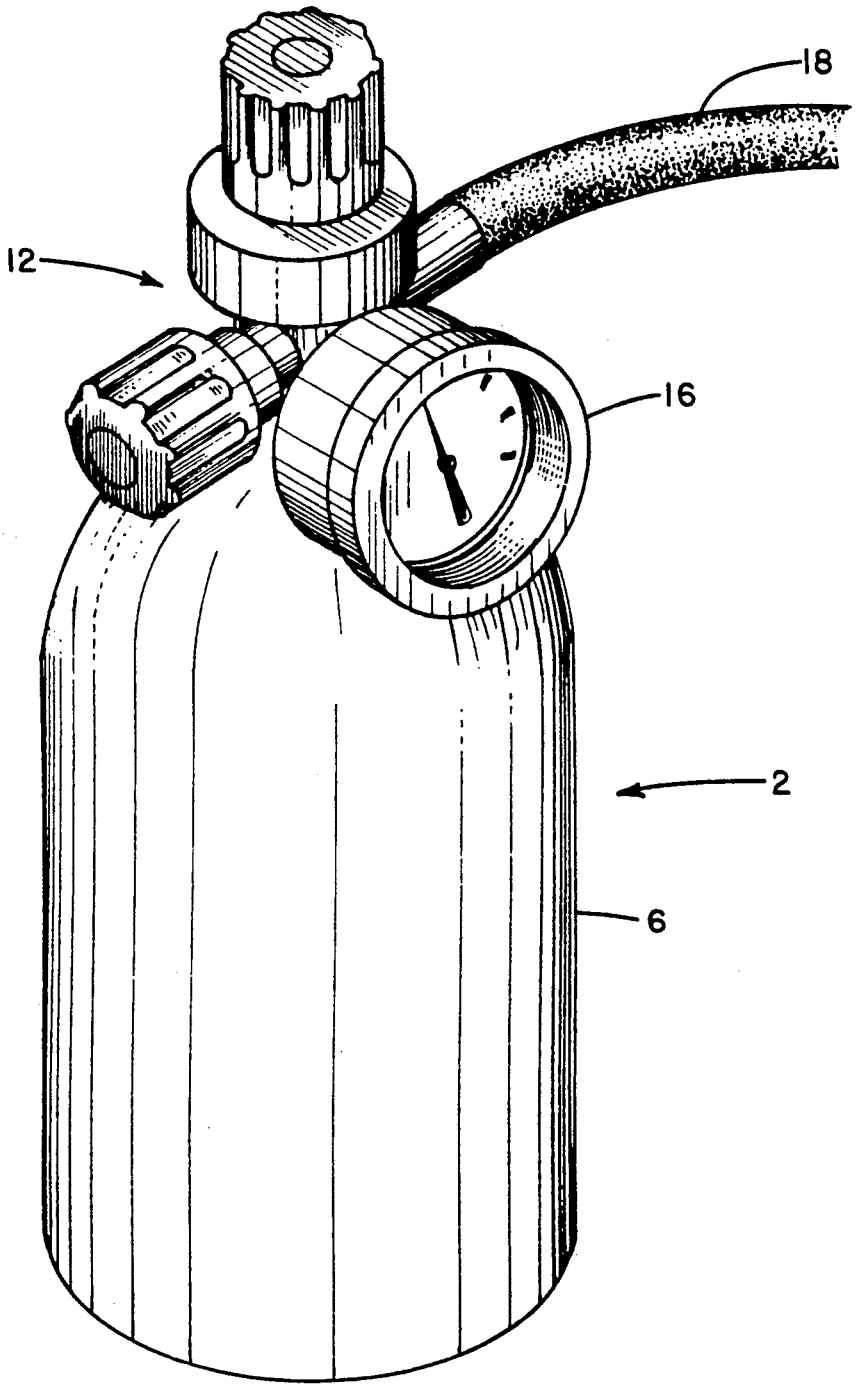
FIG. 6 is a three dimensional view of a typical pressurized breathing vessel.
Figure 7:
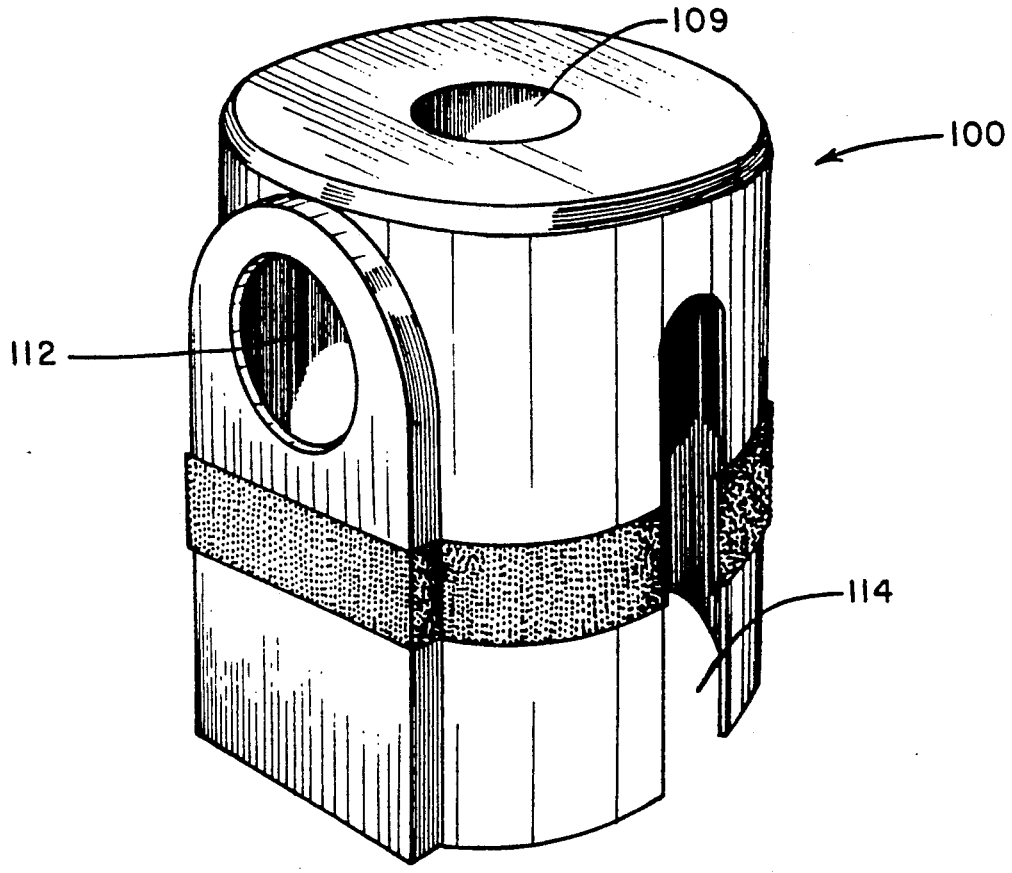
FIG. 7 is a three dimensional view of the protective valving member.

FIG. 6 shows a three dimensional view of a typical pressurized breathing vessel with a view of the pressure gauge 12. FIG. 7 has also been provided to show a three dimensional view of the protective member 100, and in paritcular, the top apperature 109, the side apperature 112 and the groove recess 114.

The foregoing disclosure and description of the invention are illustrative and explanatory thereof and various changes in the apparatus' configuration, size, shape and materials, as well as in the details of the illustrated construction, may be made within the scope to the appended claims without departing from the spirit of the invention.

What is claimed is:

1. An interchangeable protective apparatus for a pressurized breathing device, the pressurized breathing device containing a pressure gauge, a pressure output line and an end cap, said apparatus comprising:

a protective valving member constructed of rigid material; and a carrying member constructed of flexible, pliable material; and wherein said protective valving member, includes:

a top assembly having a portion defining an aperture so that said end cap can fit therethrough;

a cylindrical body, said cylindrical body being attached to said top assembly, said cylindrical body containing a portion having an aperture and sized to receive the pressure gauge so that the pressure gauge is viewable;

first means, for securing said protective valving member to said carrying member, and said first securing means contains a section having a slotted area;

and wherein said carrying member includes:

a second cylindrical body with a top and bottom end;

second means, located at the top end of said second cylindrical body, for securing said carrying member to said protective valving member by mating with said first means and wherein as said first and second securing means are secured together, the slotted area will decrease in size in order to properly secure to the pressurized breathing device and wherein the pressure output line fits therethrough.

2. The apparatus of claim 1, further comprising:

an auxiliary member, said auxiliary member being attached to said carrying member.

3. The apparatus of claim 1, further comprising:

belt means for fastening said carrying member around the waist of the operator.

4. The apparatus of claim 1, further comprising:

shoulder means for fastening said carrying member around the shoulder of the operator.

5. The apparatus of claim 1, wherein said protective valving member is constructed of plastic.

6. The apparatus of claim 5, wherein said plastic is poly properlene.

7. The apparatus of claim wherein said carrying member is constructed of reinforced vinyl nylon.

8. The apparatus of claim 1, wherein said means of securing said protective valving member is velcro.

9. The apparatus of claim 2, wherein said means for securing said carrying member to said protective valving member is velcro.

10. The apparatus of claim 2, wherein said auxiliary member further comprises:

means for securing said auxiliary member to said carrying member; and, wherein said carrying member further comprises means for securing said carrying member to said auxiliary member.

11. The apparatus of claim 9, wherein said protective valving member further comprises:

spacing means for properly adjusting the spacing between said protective member and the pressurized breathing device, and wherein said spacing means comprises an o-ring member.

12. The apparatus of claim 1, wherein said carrying member is constructed of plastic.

13. The apparatus of claim 12, wherein said means for securing said protective valving member is external thread means.

14. The apparatus of claim 13, wherein said means for securing to said protective valving member is internal thread means.

15. An apparatus for encapsulating a pressurized vessel, the vessel containing a pressure gauge, a pressure output line and an end cap, said apparatus comprising:

a first cylindrical member, said cylindrical member comprising: a top end, said top end having a portion defining an aperture so that the end cap of the pressure vessel can fit therethrough; and projection window portion defining an aperture to view the pressure gauge and the first cylindrical member is constructed of rigid material, the first cylindrical member having first attaching means and a section having a slotted area, the slotted area being disposed on said first attaching means;

container means for containing the pressure vessel, and said container means is constructed of flaccid material; and, wherein said container means comprises a second cylindrical member with a top end and a bottom end, second means for attaching said container means to said first cylindrical member, said first and second attaching means mating to obtain a variable size around said pressurized vessel and wherein the pressure output line fits therethrough said slotted area.

16. The apparatus of claim 15, wherein said cylindrical member is constructed of plastic and said container means is constructed of vinyl.

17. The apparatus of claim 16, further comprising:

carrying means, attached to said cylindrical member, for carrying the cylindrical member; and, an auxiliary member, attached about the outer periphery of said cylindrical member.

18. The apparatus of claim 17, further comprising:

first attachment means, located about said cylindrical member, for attaching said cylindrical member to said container means; and, second attachment means, located on said container means, for attaching said container means to said cylindrical member and cooperating with said first attachment means.

* * * * *